US008165871B2

(12) United States Patent
Lee et al.

(10) Patent No.: US 8,165,871 B2
(45) Date of Patent: Apr. 24, 2012

(54) ENCODING METHOD AND APPARATUS FOR EFFICIENTLY ENCODING SINUSOIDAL SIGNAL WHOSE MAGNITUDE IS LESS THAN MASKING VALUE ACCORDING TO PSYCHOACOUSTIC MODEL AND DECODING METHOD AND APPARATUS FOR DECODING ENCODED SINUSOIDAL SIGNAL

(75) Inventors: Nam-suk Lee, Suwon-si (KR); Geon-hyoung Lee, Hwaseong-si (KR); Chul-woo Lee, Suwon-si (KR); Han-gil Moon, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 996 days.

(21) Appl. No.: 12/131,446

(22) Filed: Jun. 2, 2008

(65) Prior Publication Data

US 2009/0048826 A1 Feb. 19, 2009

(30) Foreign Application Priority Data

Aug. 16, 2007 (KR) ..... 10-2007-0082287

(51) Int. Cl.
*G10L 19/00* (2006.01)

(52) U.S. Cl. ..... 704/200.1; 704/200; 704/201; 704/500; 704/502; 704/504

(58) Field of Classification Search ..... None
See application file for complete search history.

(56) References Cited

U.S. PATENT DOCUMENTS 5,274,711 A * 12/1993 Rutledge et al. ..... 704/225
6,266,644 B1 * 7/2001 Levine ..... 704/503
7,120,587 B2 * 10/2006 Heusdens et al. ..... 704/500
2004/0204936 A1 10/2004 Jensen et al.
2005/0078832 A1 4/2005 Van De Par et al.
2006/0015328 A1 1/2006 Van Schijndel et al.
2007/0016403 A1 1/2007 Schuller et al.
2007/0198274 A1 * 8/2007 Van De Par et al. ..... 704/500
2009/0138271 A1 * 5/2009 Christensen et al. ..... 704/500

FOREIGN PATENT DOCUMENTS

WO 2006/030340 A2 3/2006

OTHER PUBLICATIONS

"Text of 14496-3:2001:/FDAM 2, Parametric Coding" ITU Study Group 16—Video Coding Experts Group—ISO/IEC MPEG & ITU-T VCEG (ISO/IEC JTC1/SC29/WG11 and ITU-T SG16 Q6), No. N6130, Feb. 23, 2004, XP030013089.

(Continued)

*Primary Examiner* — Leonard Saint Cyr
(74) *Attorney, Agent, or Firm* — Sughrue Mion, PLLC

(57) ABSTRACT

Provided are an encoding method and apparatus for efficiently encoding a sinusoidal signal whose magnitude is less than a masking value according to a psychoacoustic model, a decoding method and apparatus for decoding an encoded sinusoidal signal, and a computer-readable recording medium having recorded thereon a program for executing the encoding method/the decoding method. By using a particular code indicating that the magnitude of a first sinusoidal signal is less than a masking value according to a psychoacoustic model to encode the first sinusoidal signal, difference coding for a third sinusoidal signal of a next frame, which is connected to the first sinusoidal signal, is performed using a sinusoidal signal or sinusoidal signals selected according to a method to use the particular code, and a decoding apparatus obtains a sum with a transmitted difference using the selected sinusoidal signal(s).

22 Claims, 6 Drawing Sheets

OTHER PUBLICATIONS

Taori R et al: "Closed-loop tracking of sinusoids for speech and audio coding" IEEE Workshop on Speech Coding Proceedings. Model, Coders Anderror Criteria, Jun. 20, 1999, pp. 1-3, XP002149588.

Extended European Search Report dated Oct. 21, 2010 in counterpart European Application No. 08765913.2.

* cited by examiner

ENCODING METHOD AND APPARATUS FOR EFFICIENTLY ENCODING SINUSOIDAL SIGNAL WHOSE MAGNITUDE IS LESS THAN MASKING VALUE ACCORDING TO PSYCHOACOUSTIC MODEL AND DECODING METHOD AND APPARATUS FOR DECODING ENCODED SINUSOIDAL SIGNAL

CROSS-REFERENCE TO RELATED PATENT APPLICATION

This application claims priority from Korean Patent Application No. 10-2007-82287, filed on Aug. 16, 2007 in the Korean Intellectual Property Office, the disclosure of which is incorporated herein in its entirety by reference.

BACKGROUND OF THE INVENTION

1. Field of the Invention

Methods and apparatuses consistent with the present invention generally relate to processing an audio signal, and more particularly, to encoding a sinusoidal signal whose magnitude is less than a masking value according to a psychoacoustic model, and decoding an encoded sinusoidal signal.

2. Description of the Related Art

Parametric coding expresses an audio signal by a particular parameter. Parametric coding is used in the Moving Picture Experts Group (MPEG)-4 standard.

In parametric coding, parameters for audio components in each domain are extracted by performing three types of analysis, i.e., transient analysis, sinusoidal analysis, and noise analysis. The extracted parameters are formatted into a bitstream for transmission to a decoder.

After sinusoidal analysis, a sinusoidal signal is tracked for adaptive differential pulse code modulation (ADPCM) coding or differential pulse code modulation (DPCM) coding with respect to the sinusoidal signal. Tracking is a process of searching for sinusoidal components continuing from each other from among sinusoidal components included in previous and next frames and setting correspondence relationship between the found sinusoidal components.

A sinusoidal component of a current frame, which can be tracked from sinusoidal components of a previous frame, is referred to as a continuation sinusoidal component. Since difference-coding can be performed on continuation sinusoidal components using sinusoidal components of the previous frame, which correspond to the continuation sinusoidal components, the continuation sinusoidal components can be efficiently coded. A continuation sinusoidal component, which does not continue to a sinusoidal component of a next frame and disappears, is referred to as a death sinusoidal component.

On the other hand, a sinusoidal component of the current frame, which cannot be tracked from sinusoidal components of the previous frame, is referred to as a birth sinusoidal component. Difference-coding using sinusoidal components of the previous frame cannot be performed on a birth sinusoidal component and absolute-coding can be performed on the birth sinusoidal component. Thus, the birth sinusoidal component requires a large number of bits for encoding.

In encoding of audio data, attempts are made to reduce the number of bits of encoded data using a psychoacoustic model. FIG. 1A is a diagram for explaining a masking effect according to a psychoacoustic model.

As illustrated in FIG. 1A, when a particular audio signal 4 exists, sounds whose signal magnitudes are less than the magnitude of the audio signal 4 are not audible to human ears.

A line expressing the minimum magnitude of a signal that is audile to human ears under existence of the particular audio signal 4 is called a masking curve 2 and a value of the masking curve 2 at a particular frequency is called a masking value.

Referring to FIG. 1A, the magnitude of a sinusoidal signal 6 is greater than a masking value and thus the sinusoidal signal 6 can be heard by human hears. Thus, the sinusoidal signal 6 must be encoded.

On the other hand, the magnitude of a sinusoidal signal 8 is less than the masking value and thus the sinusoidal signal 8 cannot be heard by human ears. For this reason, the sinusoidal signal 8 is not encoded in encoding using a psychoacoustic model. In other words, encoding using a psychoacoustic model processes a sinusoidal signal whose magnitude is less than a masking value as not existing.

FIG. 1B is a diagram for explaining how a sinusoidal signal whose magnitude is less than a masking value according to a psychoacoustic model is treated in sinusoidal tracking.

Referring to FIG. 1B, a sinusoidal signal 10 has a magnitude that is less than a masking value according to a psychoacoustic model. The magnitude of the sinusoidal signal 10 is less than the magnitudes of sinusoidal signals 18 and 20 within the same frame as the sinusoidal signal 10.

When the psychoacoustic model is not applied, the sinusoidal signal 10 is connected with a sinusoidal signal 12 of a previous frame and with a sinusoidal signal 14 of a next frame. Thus, tracking of the sinusoidal signal 12, the sinusoidal signal 10, and the sinusoidal signal 14 is performed, and thus difference coding that is applicable to a continuation sinusoidal signal can be performed on the sinusoidal signal 14.

However, when the psychoacoustic model is applied, signals whose magnitudes are less than the masking value are treated as not existing like in an empty place 16 treated as not having any signal.

When the psychoacoustic model is applied, the sinusoidal signal 10 is treated as not existing and thus the sinusoidal signal 14 is treated as a birth sinusoidal signal, requiring a large number of bits for encoding.

If signals whose magnitudes are less than the masking value according to the psychoacoustic model are treated as not existing, a sinusoidal signal of a next frame has to be coded as a birth sinusoidal signal.

Moreover, even when such signals whose magnitudes are less than the masking value are coded, problems still occur.

FIG. 2 is a flowchart illustrating a related art method for processing a signal whose magnitude is less than the masking value according to the psychoacoustic model.

First, sinusoidal tracking is performed in operation S10. It is assumed that P(n−2) and P(n−1) are connected and P(n−1) and P(n) are connected as a result of sinusoidal tracking.

In operation S20, P(n−1) is assumed to a signal having a magnitude that is less than the masking value according to the psychoacoustic model. Such a signal may have an amplitude of a small value or 0.

In operation S30, it is determined whether to code P(n−1) according to one of the previously mentioned two methods where the psychoacoustic model is applied or is not applied.

When the psychoacoustic model is applied and thus P(n−1) is treated as not existing, P(n−1) is not coded in operation S40 and P(n) that is a sinusoidal signal of a next frame is absolute-coded according to an encoding method for a birth sinusoidal signal in operation S50.

When it is determined to code P(n−1), difference coding between P(n−1) and P(n−2) is performed according to an encoding method for a continuation sinusoidal signal in operation S60 and difference coding between P(n) and P(n−1) is performed in operation S70.

As discussed above, when P(n−1) is not coded in operation S40, a large number of bits are required to code amplitude, frequency, and phase components because the encoding method for a birth sinusoidal signal is applied to P(n−1).

When P(n−1) is coded in operation S60, the number of bits used to code the frequency or amplitude component is small. However, since the amplitude of P(n−1) is small or equal to 0, a difference between the amplitude of P(n−1) and the amplitude of P(n−2) is very large. Also, the difference between the amplitude of P(n) and the amplitude of P(n−1) is very large. Thus, a large number of bits may be used to encode the difference or the difference may be in a range that cannot be expressed.

As such, in order to encode an audio signal including a sinusoidal signal whose magnitude is less than a masking value according to a psychoacoustic model using the related art method, a more number of bits than a case with coding of a general sinusoidal signal are required, degrading the efficiency of encoding.

SUMMARY OF THE INVENTION

The present invention provides an encoding method and apparatus for efficiently encoding a sinusoidal signal whose magnitude is less than a masking value according to a psychoacoustic model and a decoding method and apparatus for decoding an encoded sinusoidal signal.

According to an aspect of the present invention, there is provided an encoding method of encoding a sinusoidal signal. The encoding method includes performing sinusoidal tracking for an audio signal including a first sinusoidal signal whose magnitude is less than a masking value according to a psychoacoustic model in order to determine a second sinusoidal signal connected to the first sinusoidal signal from among sinusoidal signals of a previous frame preceding a current frame including the first sinusoidal signal and a third sinusoidal signal connected to the first sinusoidal signal from among sinusoidal signals of a next frame following the current frame including the first sinusoidal signal, encoding the first sinusoidal signal using a particular code indicating that a magnitude of the first sinusoidal signal is less than the masking value according to the psychoacoustic model, and encoding the third sinusoidal signal by performing difference coding for the third sinusoidal signal using only the second sinusoidal signal or both the first sinusoidal signal and the second sinusoidal signal.

According to another aspect of the present invention, there is provided an encoding apparatus for encoding a sinusoidal signal. The encoding apparatus includes a sinusoidal tracking unit, a first encoding unit, and a second encoding unit. The sinusoidal tracking unit performs sinusoidal tracking for an audio signal including a first sinusoidal signal whose magnitude is less than a masking value according to a psychoacoustic model in order to determine a second sinusoidal signal connected to the first sinusoidal signal from among sinusoidal signals of a previous frame preceding a current frame including the first sinusoidal signal and a third sinusoidal signal connected to the first sinusoidal signal from among sinusoidal signals of a next frame following the current frame including the first sinusoidal signal. The first encoding unit encodes the first sinusoidal signal using a particular code indicating that a magnitude of the first sinusoidal signal is less than the masking value according to the psychoacoustic model. The second encoding unit encodes the third sinusoidal signal by performing difference coding for the third sinusoidal signal using only the second sinusoidal signal or both the first sinusoidal signal and the second sinusoidal signal.

According to another aspect of the present invention, there is provided a decoding method of decoding a sinusoidal signal. The decoding method includes extracting a particular code indicating that a magnitude of a first sinusoidal signal, which is connected to a third sinusoidal signal to be decoded from among sinusoidal signals of a previous frame preceding a current frame including the third sinusoidal signal, is less than a masking value according to a psychoacoustic model from an input bitstream and decoding the third sinusoidal signal using only a second sinusoidal signal, which is connected to the first sinusoidal signal from among sinusoidal signals of a previous frame preceding the previous frame including the first sinusoidal signal, or both the first sinusoidal signal and the second sinusoidal signal according to a type of the particular code.

According to another aspect of the present invention, there is provided a decoding apparatus for decoding a sinusoidal signal. The decoding apparatus includes a code extraction unit and a sinusoidal signal decoding unit. The code extraction unit extracts a particular code indicating that a magnitude of a first sinusoidal signal, which is connected to a third sinusoidal signal to be decoded from among sinusoidal signals of a previous frame preceding a current frame including the third sinusoidal signal, is less than a masking value according to a psychoacoustic model from an input bitstream. The sinusoidal signal decoding unit decodes the third sinusoidal signal using only a second sinusoidal signal, which is connected to the first sinusoidal signal from among sinusoidal signals of a previous frame preceding the previous frame including the first sinusoidal signal, or both the first sinusoidal signal and the second sinusoidal signal according to a type of the particular code.

BRIEF DESCRIPTION OF THE DRAWINGS

The above and other aspects of the present invention will become more apparent by describing in detail an exemplary embodiment thereof with reference to the attached drawings in which.

DETAILED DESCRIPTION OF EXEMPLARY EMBODIMENTS OF THE INVENTION

Figure 1A:
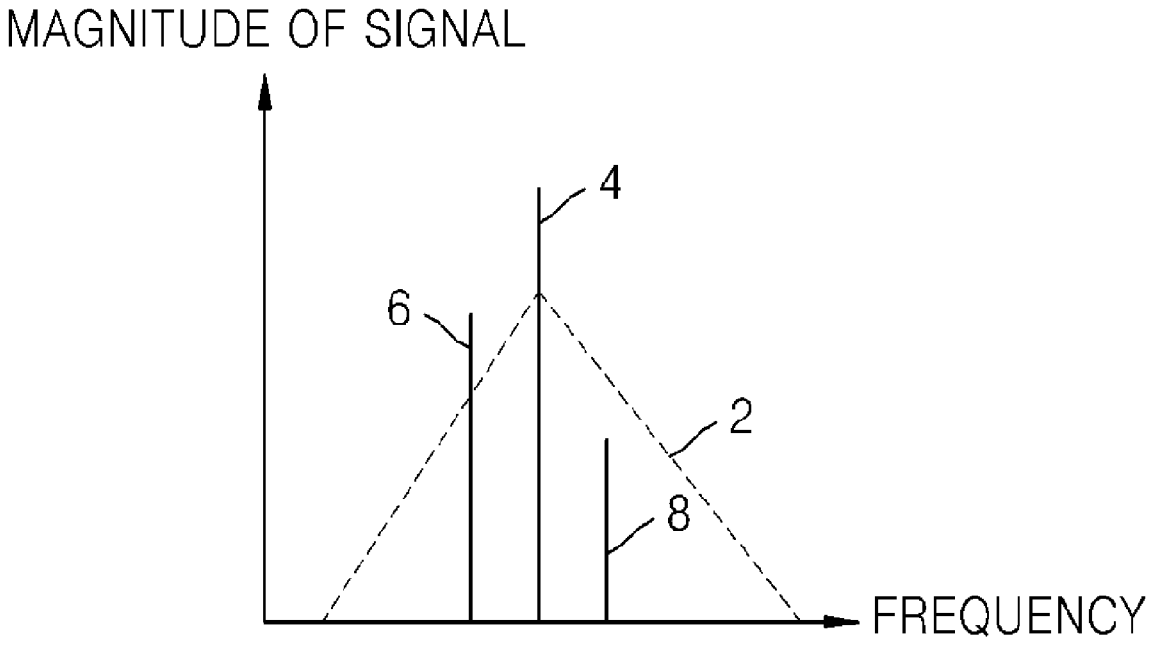
FIG. 1A (RELATED ART)
FIG. 1A is a diagram for explaining a masking effect according to a psychoacoustic model.
Figure 1B:
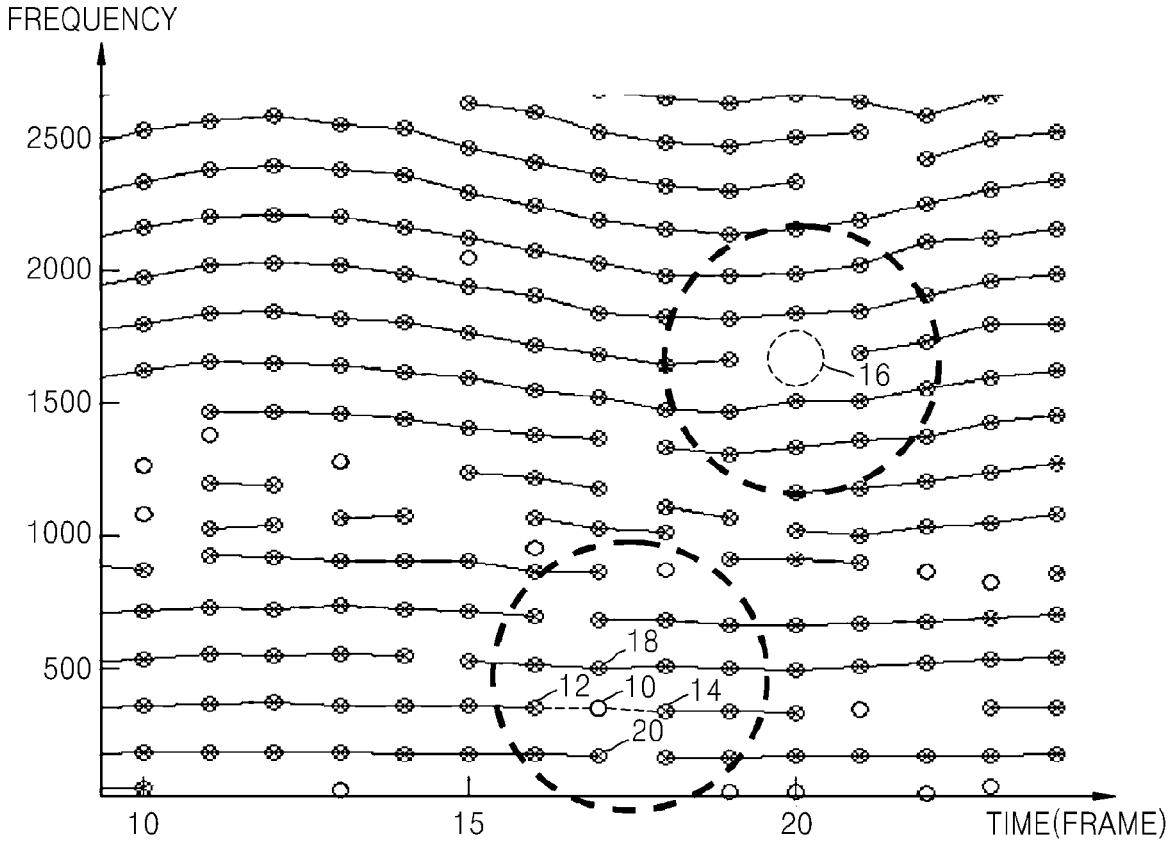
FIG. 1B (RELATED ART)
FIG. 1B is a diagram for explaining how a sinusoidal signal whose magnitude is less than a masking value according to the psychoacoustic model is treated in sinusoidal tracking.
Figure 2:
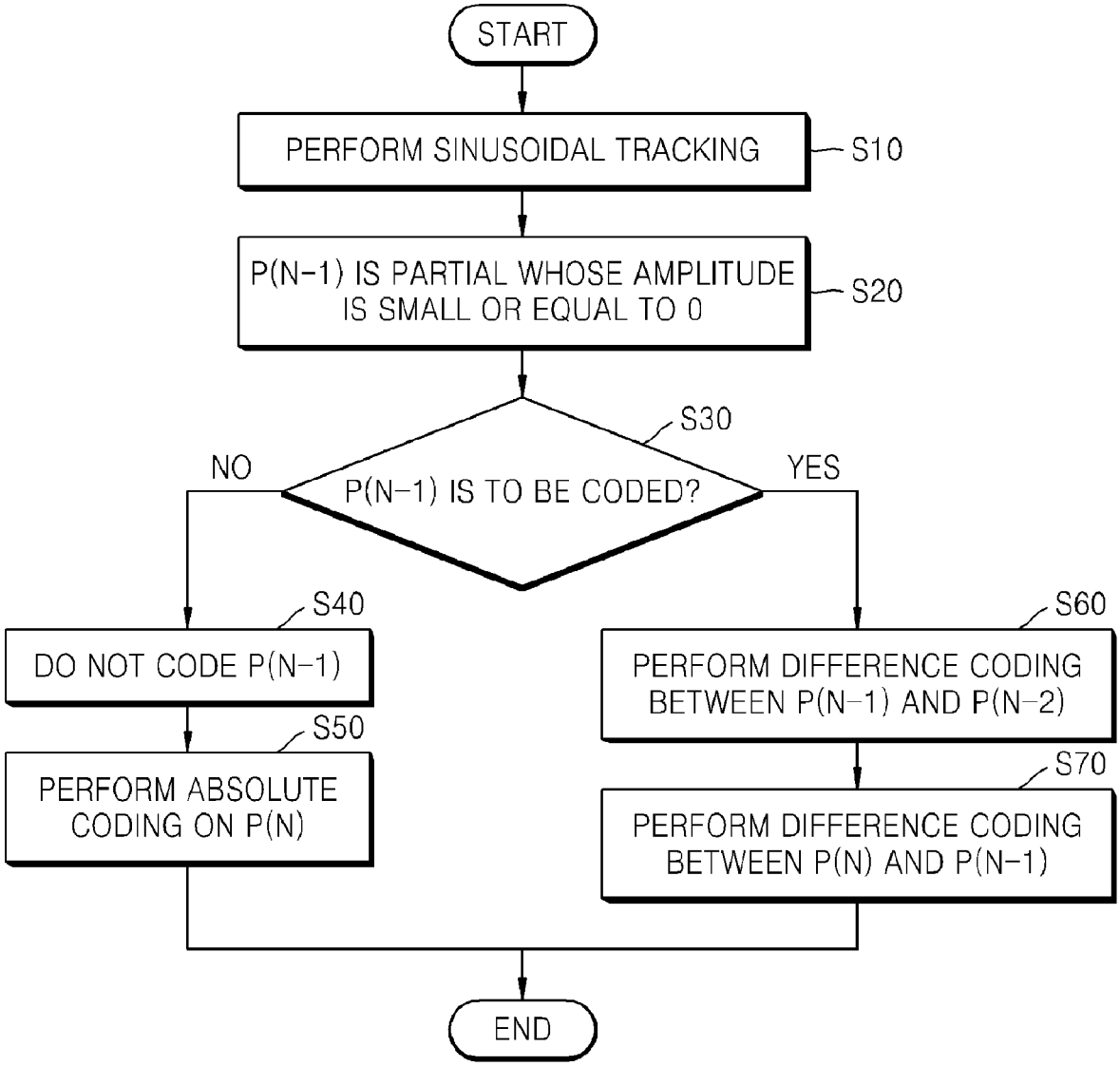
FIG. 2 is a flowchart illustrating a related art method for processing a signal whose magnitude is less than the masking value according to the psychoacoustic model.

Hereinafter, an exemplary embodiment of the present invention will be described in detail with reference to the accompanying drawings. It should be noted that like reference numerals refer to like elements illustrated in one or more of the drawings. In the following description of the present invention, detailed description of known functions and configurations incorporated herein will be omitted for conciseness and clarity.

Figure 3:
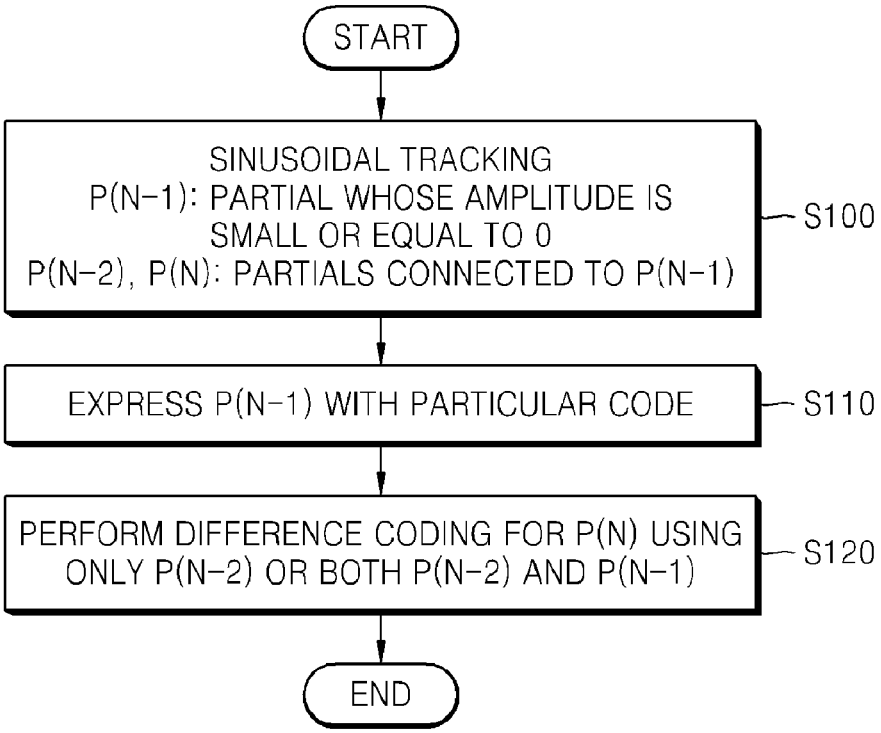
FIG. 3 is a flowchart illustrating an encoding method of encoding a sinusoidal signal according to an exemplary embodiment of the present invention.
Figure 4:
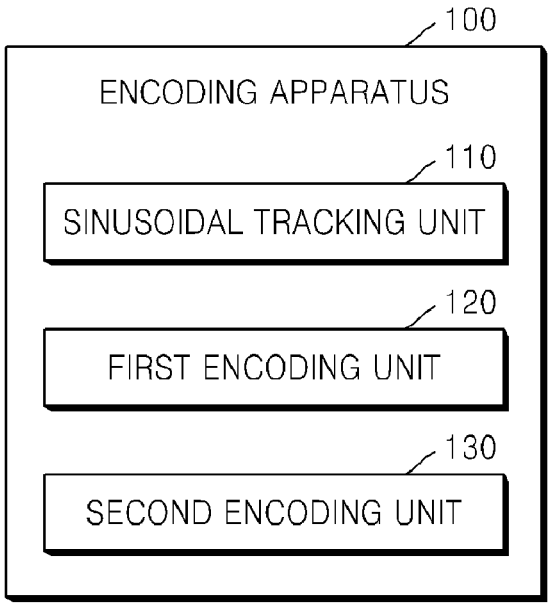
FIG. 4 is a block diagram of an encoding apparatus for encoding a sinusoidal signal according to an exemplary embodiment of the present invention.

FIG. 3 is a flowchart illustrating an encoding method of encoding a sinusoidal signal according to an exemplary embodiment of the present invention, and FIG. 4 is a block diagram of an encoding apparatus 100 for encoding a sinusoidal signal according to an exemplary embodiment of the present invention.

Referring to FIG. 4, the encoding apparatus 100 may include a sinusoidal tracking unit 110, a first encoding unit 120, and a second encoding unit 130.

It is assumed that P(n−1) is a sinusoidal signal whose magnitude is less than a masking value according to a psychoacoustic model and P(n−2) and P(n−1) are connected and P(n−1) and P(n) are connected. In the following description, a sinusoidal signal whose magnitude is less than the masking value according to the psychoacoustic model is a first sinusoidal signal of sinusoidal signals of a current frame, one of sinusoidal signals of a previous frame, which is connected to the first sinusoidal signal, is a second sinusoidal signal, and one of sinusoidal signals of a next frame, which is connected to the first sinusoidal signal, is a third sinusoidal signal.

In operation S100, the sinusoidal tracking unit 110 performs sinusoidal tracking in order to determine the second sinusoidal signal and the third sinusoidal signal connected to the first sinusoidal signal.

In FIG. 3, the first sinusoidal signal is P(n−1), the second sinusoidal signal is P(n−2), and the third sinusoidal signal is P(n).

In operation S110, the first encoding unit 120 encodes the first sinusoidal signal by expressing P(n−1), i.e., the first sinusoidal signal, with a particular code. The first encoding unit 120 uses the particular code indicating that the magnitude of the first sinusoidal signal is less than the masking value according to the psychoacoustic model.

In operation S120, the second encoding unit 130 encodes P(n), i.e., the third sinusoidal signal. The second encoding unit 130 may perform difference coding for the third sinusoidal signal P(n) using only the second sinusoidal signal P(n−2) or both the first sinusoidal signal P(n−1) and the second sinusoidal signal P(n−2) according to a method for the first encoding unit 120 to use the particular code.

The method to use the particular code may include the following examples. However, the method is not limited to the examples and may vary as long as the first encoding unit 120 uses the particular code indicating that the magnitude of the first sinusoidal signal is less than the masking value according to the psychoacoustic model.

<Method to Use Particular Code>

1. Designating one of control flags as a flag indicating that the sinusoidal signal to be encoded has a magnitude that is less than the masking value according to the psychoacoustic model.

Control flags are used to encode a sinusoidal signal. By designating one of the control flags, it can be indicated that the sinusoidal signal to be encoded has a magnitude that is less than a masking value according to a psychoacoustic model. When such control flag is designated, it is not necessary to encode amplitude, frequency, and phase components of the first sinusoidal signal. For the third sinusoidal signal of the next frame, difference coding may be performed using the second sinusoidal signal. When compared to a related art method in which the first sinusoidal signal is treated as not existing, the number of bits can be reduced by performing difference coding for encoding of the third sinusoidal signal.

2. Encoding a particular value indicating that the magnitude of the first sinusoidal signal is less than the masking value according to the psychoacoustic model instead of encoding the amplitude component of the first sinusoidal signal.

For frequency and phase components of the first sinusoidal signal, difference coding is performed using frequency and phase components of the second sinusoidal signal of the previous frame. In this method, during encoding of the third sinusoidal signal, difference coding for an amplitude component of the third sinusoidal signal is performed using an amplitude component of the second sinusoidal signal, difference coding for a frequency component of the third sinusoidal signal is performed using a frequency component of the first sinusoidal signal, and difference coding for a phase component of the third sinusoidal signal is performed using the phase component of the first sinusoidal signal. By performing difference coding instead of absolute coding for encoding of the third sinusoidal signal, the number of bits required for the encoding can be reduced. Moreover, when compared to a related art method in which difference coding for the third sinusoidal signal is performed using only the first sinusoidal signal, related art problems that a large number of bits are required for encoding a difference or the difference is in a range that cannot be expressed can be solved by performing difference coding for the amplitude component of the third sinusoidal signal using the amplitude component of the second sinusoidal signal.

3. Encoding a particular value indicating that the magnitude of the first sinusoidal signal is less than the masking value according to the psychoacoustic model instead of encoding the frequency component (or phase component) of the first sinusoidal signals.

In this method, it is not necessary to encode amplitude and phase components (or frequency component) of the first sinusoidal signal. In this sense, this method is similar to the first method in which one of control flags is designated as a flag indicating that the sinusoidal signal to be encoded has a magnitude that is less than the masking value according to the psychoacoustic model.

For the third sinusoidal signal of the next frame, difference coding is performed using the second sinusoidal signal. When compared to the related art method that treats the first sinusoidal signal as not existing, this method can reduce the number of bits by performing difference coding for encoding of the third sinusoidal signal.

This method is similar to the first method and one of them may be selected to further reduce the number of bits according to embodiments. In other words, one of the first method using a particular code in the flag and this method encoding the particular value instead of the frequency or phase component of the first sinusoidal signal, which results in a smaller number of bits for encoding, can be selected.

In some embodiments, it may be difficult to additionally designate a particular flag. In this case, such a difficulty can be overcome using this method.

<Method to Encode Third Sinusoidal Signal>

A. When the first encoding unit 120 uses one of the first method and the third method the second encoding unit 130 performs difference coding for the third sinusoidal signal using only the second sinusoidal signal.

Figure 5:
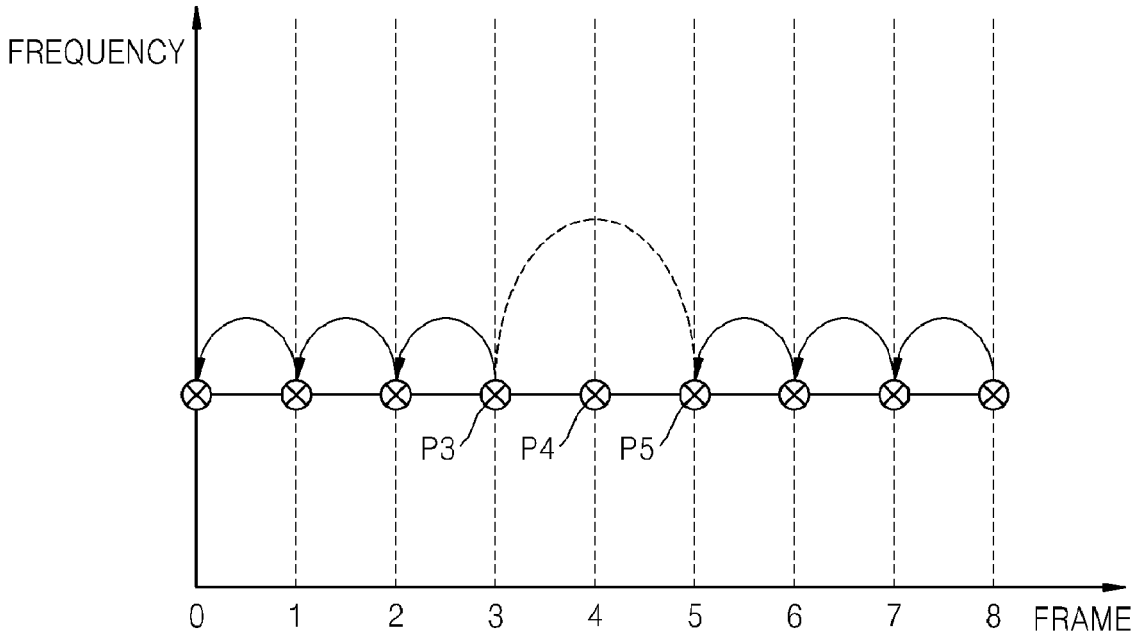
FIG. 5 illustrates a graph corresponding to encoding of a third sinusoidal signal using only a second sinusoidal signal.

FIG. 5 illustrates a graph corresponding to encoding of the third sinusoidal signal using only the second sinusoidal signal. In FIG. 5, n is 5. Thus, the first sinusoidal signal is P4, the second sinusoidal signal is P3, and the third sinusoidal signal is P5.

To encode the first sinusoidal signal P4, a particular flag is designated according to the first method or a particular value is encoded instead of a frequency or phase component of the first sinusoidal signal P4 according to the third method.

To encode the third sinusoidal signal P5, difference coding is performed using only the second sinusoidal signal P3. In other words, for an amplitude component of the third sinusoidal signal P5, a difference between the amplitude component of the third sinusoidal signal P5 and an amplitude component of the second sinusoidal signal P3 is obtained and is then encoded, for a frequency component of the third sinusoidal signal P5, a difference between the frequency component of the third sinusoidal signal P5 and a frequency component of the second sinusoidal signal P3 is obtained and is then encoded, and for a phase component of the third sinusoidal signal P5, a difference between the phase component of the third sinusoidal signal P5 and a phase component of the second sinusoidal signal P3 is obtained and is then encoded.

B. When the first encoding unit 120 uses the second method the second encoding unit 130 performs difference coding for the third sinusoidal signal using both the first sinusoidal signal and the second sinusoidal signal.

Figure 6:
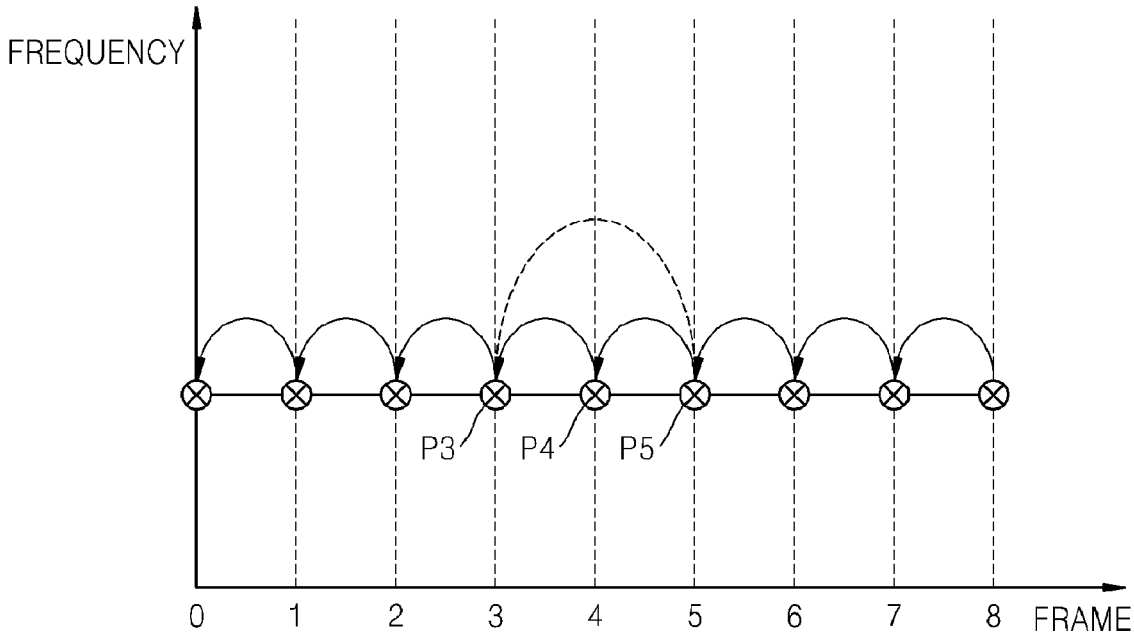
FIG. 6 illustrates a graph corresponding to encoding of the third sinusoidal signal using both a first sinusoidal signal and the second sinusoidal signal.

FIG. 6 illustrates a graph corresponding to encoding of the third sinusoidal signal using both the first sinusoidal signal and the second sinusoidal signal. In FIG. 6, n is 5. Thus, the first sinusoidal signal is P4, the second sinusoidal signal is P3, and the third sinusoidal signal is P5.

To encode the first sinusoidal signal P4, a particular value is encoded instead of an amplitude component of the first sinusoidal signal P4 according to the second method. In other words, for a frequency component of the first sinusoidal signal P4, a difference between the frequency component of the first sinusoidal signal P4 and a frequency component of the second sinusoidal signal P3 is obtained and is then encoded, and for a phase component of the first sinusoidal signal P4, a difference between the phase component of the first sinusoidal signal P4 and a phase component of the second sinusoidal signal P3 is obtained and is then encoded.

To encode the third sinusoidal signal P5, difference coding is performed using both the second sinusoidal signal P3 and the first sinusoidal signal P4. In other words, for an amplitude component of the third sinusoidal signal P5, a difference between the amplitude component of P5 and an amplitude component of the second sinusoidal signal P3 is obtained and is then encoded, for a frequency component of the third sinusoidal signal P5, a difference between the frequency component of the third sinusoidal signal P5 and a frequency component of the first sinusoidal signal P4 is obtained and is then encoded, and for a phase component of the third sinusoidal signal P5, a difference between the phase component of the third sinusoidal signal P5 and a phase component of the first sinusoidal signal P4 is obtained and is then encoded.

Although not illustrated in FIG. 4, the encoding apparatus 100 may further include a frequency conversion unit. The frequency conversion unit converts a frequency of the first sinusoidal signal and transmits the frequency-converted first sinusoidal signal to the first encoding unit 120.

When the frequency component of the second sinusoidal signal is fp and the frequency component of the third sinusoidal signal is fn, the frequency conversion unit converts the frequency of the first sinusoidal signal into an average frequency value of the frequencies of the second sinusoidal signal and the third sinusoidal signal, i.e., (fp+fn)/2.

The encoded sinusoidal signal is formatted into a bitstream for transmission to a decoding apparatus for decoding a sinusoidal signal from the encoding apparatus 100.

Figure 7:
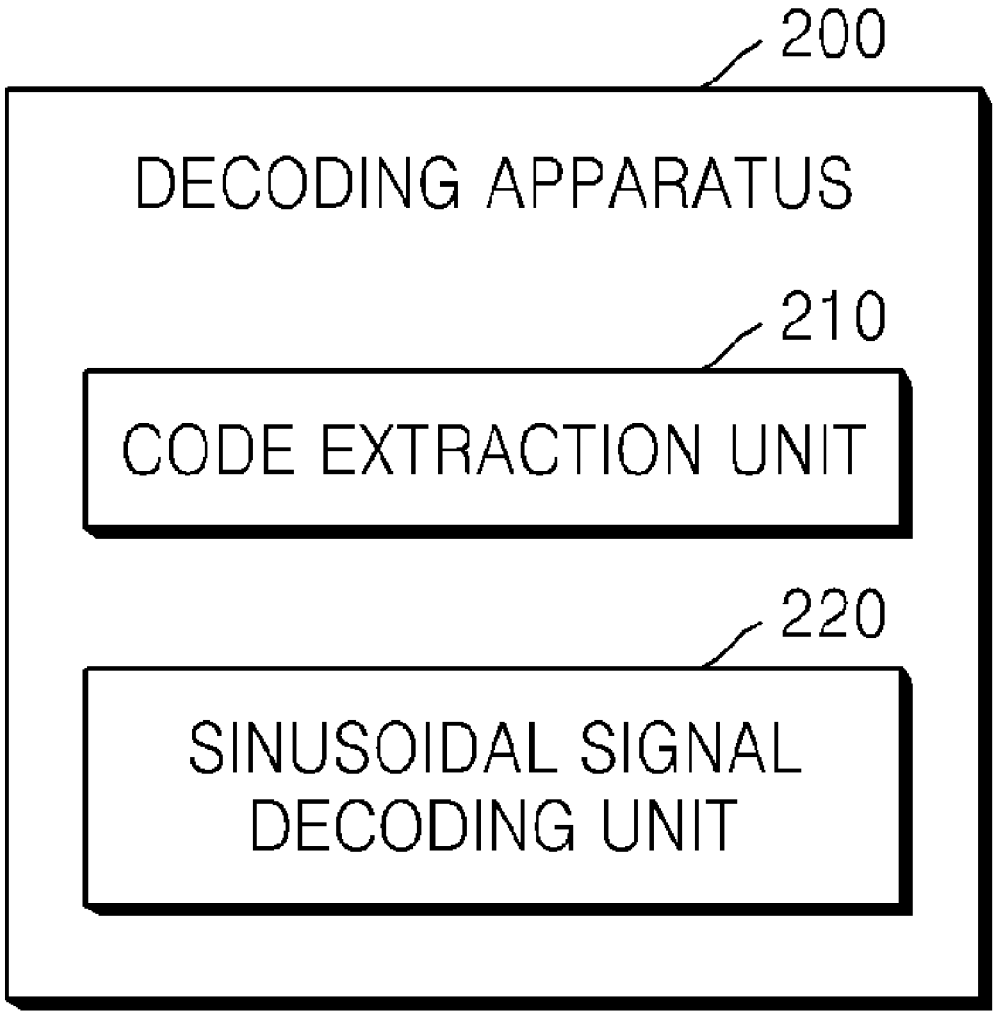
FIG. 7 is a block diagram of a decoding apparatus for decoding a sinusoidal signal according to an exemplary embodiment of the present invention.

FIG. 7 is a block diagram of a decoding apparatus 200 for decoding a sinusoidal signal according to an exemplary embodiment of the present invention.

Referring to FIG. 7, the decoding apparatus 200 may include a code extraction unit 210 and a sinusoidal signal decoding unit 220.

The code extraction unit 210 extracts a particular code indicating that the magnitude of the first sinusoidal signal is less than the masking value according to the psychoacoustic model from the input bitstream.

The sinusoidal signal decoding unit 220 decodes the third sinusoidal signal using the second sinusoidal signal or using both the first sinusoidal signal and the second sinusoidal signal according to the type of the particular code as follows.

<Method to Decode Third Sinusoidal Signal>

A. When the encoding apparatus 100 uses the first method or the third method to use the particular code, the sinusoidal signal decoding unit 220 decodes the third sinusoidal signal using only the second sinusoidal signal.

In other words, the flag indicating that the magnitude of the first sinusoidal signal is less than the masking value according to the psychoacoustic model has been designated from among control flags used to encode the first sinusoidal signal (the first method) or the particular value indicating that the magnitude of the first sinusoidal signal is less than the masking value according to the psychoacoustic model has been encoded instead of the frequency (or phase) component of the first sinusoidal signal (the second method), and the flag or the encoded particular value has been included in the input bitstream.

Since the amplitude (frequency or phase) component of the first sinusoidal signal has not been encoded, an encoded difference for the amplitude (frequency or phase) component of the third sinusoidal signal is extracted from the input bitstream and is decoded. The decoded difference is added to an amplitude (frequency or phase) component of the second sinusoidal signal, thereby obtaining an amplitude (frequency or phase) component of the third sinusoidal signal.

B. When the encoding apparatus 100 uses the second method to use the particular code, the sinusoidal signal decoding unit 220 decodes the third sinusoidal signal using both the first sinusoidal signal and the second sinusoidal signal.

In other words, the particular value indicating that the magnitude of the first sinusoidal signal is less than the masking value according to the psychoacoustic model has been encoded instead of the amplitude component of the first sinusoidal signal and has been included in the input bitstream.

Since the amplitude component of the first sinusoidal signal is not encoded, an encoded difference for the amplitude component of the third sinusoidal signal is extracted from the input bitstream and is then decoded. The decoded difference is added to the amplitude component of the second sinusoidal signal, thereby obtaining the amplitude component of the third sinusoidal signal.

On the other hand, for the frequency and phase components of the first sinusoidal signal, the encoding apparatus 100 has performed difference coding using the frequency and phase components of the second sinusoidal signal. Thus, an encoded difference for the frequency (phase) component of the first sinusoidal signal is extracted from the input bitstream and is decoded. The decoded difference is added to the frequency (phase) component of the second sinusoidal signal, thereby obtaining the frequency (phase) component of the first sinusoidal signal.

An encoded difference for the frequency (phase) component of the third sinusoidal signal is extracted from the input bitstream and is decoded. The decoded difference is added to the frequency (phase) component of the first sinusoidal signal, thereby obtaining the frequency (phase) component of the third sinusoidal signal.

<Designation of Components of First Sinusoidal Signal>

The first sinusoidal signal has a magnitude that is less than the masking value according to the psychoacoustic model. Since this signal is not audible to human ears, it may not be decoded by the decoding apparatus 200.

However, although not audible to human ears, the first sinusoidal signal may change the feeling of a sound due to its existence. Thus, a particular signal substituting the first sinusoidal signal may be designated.

First, a value that is less than the masking value according to the psychoacoustic model is designated as the amplitude component of the first sinusoidal signal.

The average frequency value (fp+fn)/2 of the frequency component fp of the second sinusoidal signal and the frequency component fn of the third sinusoidal signal is designated as the frequency component of the first sinusoidal signal.

By designating the amplitude and frequency components of the first sinusoidal signal, the first sinusoidal signal can be generated without affecting decoding of the third sinusoidal signal.

As described above, according to the exemplary embodiments of the present invention, by using the particular code indicating that the magnitude of the first sinusoidal signal is less than the masking value according to the psychoacoustic model to encode the first sinusoidal signal, difference coding for the third sinusoidal signal of the next frame, which is connected to the first sinusoidal signal, is performed using only the second sinusoidal signal of the previous frame, which is connected to the first sinusoidal signal or using both the first sinusoidal signal and the second sinusoidal signal according to a method to use the particular code, and the decoding apparatus decodes the third sinusoidal signal using a sinusoidal signal or sinusoidal signals selected according to the type of the particular code.

On the other hand, a related art method performs absolute coding or difference coding using the first sinusoidal signal for all components of the third sinusoidal signal in order to encode the third sinusoidal signal.

Therefore, when compared to the related art method, the number of bits required for encoding can be reduced and thus efficient encoding can be achieved.

The present invention can also be embodied as code that can be read by a computer including any device having an information processing function on a computer-readable recording medium. The computer-readable recording medium is any data storage device that can store data which can be thereafter read by a computer system. Examples of the computer-readable recording medium include read-only memory (ROM), random-access memory (RAM), CD-ROMs, magnetic tapes, floppy disks, and optical data storage devices.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A method of encoding a sinusoidal signal, the method comprising:

performing sinusoidal tracking for an audio signal, which comprises a first sinusoidal signal whose magnitude is less than a masking value, according to a psychoacoustic model in order to determine a second sinusoidal signal from among sinusoidal signals of a previous frame preceding a current frame which comprises the first sinusoidal signal, and a third sinusoidal signal from among sinusoidal signals of a next frame following the current frame, wherein the second sinusoidal signal and the third sinusoidal signal are connected to the first sinusoidal signal;

encoding the first sinusoidal signal using a particular code indicating that a magnitude of the first sinusoidal signal is less than the masking value according to the psychoacoustic model; and encoding the third sinusoidal signal by performing difference coding for the third sinusoidal signal using only the second sinusoidal signal or both the first sinusoidal signal and the second sinusoidal signal.

2. The method of claim 1, wherein the encoding the first sinusoidal signal using the particular code comprises designating one of control flags used to encode the first sinusoidal signal as a flag indicating that the magnitude of the first sinusoidal signal to be encoded is less than the masking value according to the psychoacoustic model.

3. The method of claim 1, wherein the encoding the first sinusoidal signal using the particular code comprises:

encoding a particular value indicating that the magnitude of the first sinusoidal signal to be encoded is less than the masking value according to the psychoacoustic model, instead of encoding an amplitude component of the first sinusoidal signal;

obtaining and encoding a difference between a frequency component of the first sinusoidal signal and a frequency component of the second sinusoidal signal; and obtaining and encoding a difference between a phase component of the first sinusoidal signal and a phase component of the second sinusoidal signal.

4. The method of claim 1, wherein the encoding the first sinusoidal signal using the particular code comprises encoding a particular value indicating that the magnitude of the first sinusoidal signal to be encoded is less than the masking value according to the psychoacoustic model, instead of encoding a frequency component or a phase component of the first sinusoidal signal.

5. The method of claim 1, further comprising, prior to the encoding the first sinusoidal signal using the particular code, converting a frequency component of the first sinusoidal signal into an average frequency value (fp+fn)/2 of a frequency component fp of the second sinusoidal signal and a frequency component fn of the third sinusoidal signal.

6. The method of claim 1, wherein the encoding the third sinusoidal signal comprises:

obtaining and encoding a difference between an amplitude component of the third sinusoidal signal and an amplitude component of the second sinusoidal signal;

obtaining and encoding a difference between a frequency component of the third sinusoidal signal and a frequency component of the second sinusoidal signal; and obtaining and encoding a difference between a phase component of the third sinusoidal signal and a phase component of the second sinusoidal signal.

7. The method of claim 1, wherein the encoding of the third sinusoidal signal comprises:

obtaining and encoding a difference between an amplitude component of the third sinusoidal signal and an amplitude component of the second sinusoidal signal;

obtaining and encoding a difference between a frequency component of the third sinusoidal signal and a frequency component of the first sinusoidal signal; and obtaining and encoding a difference between a phase component of the third sinusoidal signal and a phase component of the first sinusoidal signal.

8. An apparatus for encoding a sinusoidal signal, the apparatus comprising:

a sinusoidal tracking unit which performs sinusoidal tracking for an audio signal, which comprises a first sinusoidal signal whose magnitude is less than a masking value, according to a psychoacoustic model in order to determine a second sinusoidal signal from among sinusoidal signals of a previous frame preceding a current frame which comprises the first sinusoidal signal, and a third sinusoidal signal from among sinusoidal signals of a next frame following the current frame, wherein the second sinusoidal signal and the third sinusoidal signal are connected to the first sinusoidal signal;

a first encoding unit which encodes the first sinusoidal signal using a particular code indicating that a magnitude of the first sinusoidal signal is less than the masking value according to the psychoacoustic model; and a second encoding unit which encodes the third sinusoidal signal by performing difference coding for the third sinusoidal signal using only the second sinusoidal signal or both the first sinusoidal signal and the second sinusoidal signal.

9. The apparatus of claim 8, wherein the first encoding unit designates one of control flags used to encode the first sinusoidal signal as a flag indicating that the magnitude of the first sinusoidal signal to be encoded is less than the masking value according to the psychoacoustic model.

10. The apparatus of claim 8, wherein the first encoding unit encodes a particular value indicating that the magnitude of the first sinusoidal signal to be encoded is less than the masking value according to the psychoacoustic model, instead of encoding an amplitude component of the first sinusoidal signal, obtains and encodes a difference between a frequency component of the first sinusoidal signal and a frequency component of the second sinusoidal signal, and obtains and encodes a difference between a phase component of the first sinusoidal signal and a phase component of the second sinusoidal signal.

11. The apparatus of claim 8, wherein the first encoding unit encodes a particular value indicating that the magnitude of the first sinusoidal signal to be encoded is less than the masking value according to the psychoacoustic model, instead of encoding a frequency component or a phase component of the first sinusoidal signal.

12. The apparatus of claim 8, further comprising a frequency conversion unit which converts a frequency component of the first sinusoidal signal into an average frequency value (fp+fn)/2 of a frequency component fp of the second sinusoidal signal and a frequency component fn of the third sinusoidal signal, and transmits the frequency-converted first sinusoidal signal to the first encoding unit.

13. The apparatus of claim 8, wherein the second encoding unit obtains and encodes a difference between an amplitude component of the third sinusoidal signal and an amplitude component of the second sinusoidal signal, obtains and encodes a difference between a frequency component of the third sinusoidal signal and a frequency component of the second sinusoidal signal, and obtains and encodes a difference between a phase component of the third sinusoidal signal and a phase component of the second sinusoidal signal.

14. The apparatus of claim 8, wherein the second encoding unit obtains and encodes a difference between an amplitude component of the third sinusoidal signal and an amplitude component of the second sinusoidal signal, obtains and encodes a difference between a frequency component of the third sinusoidal signal and a frequency component of the first sinusoidal signal, and obtains and encodes a difference between a phase component of the third sinusoidal signal and a phase component of the first sinusoidal signal.

15. A computer-readable recording medium having recorded thereon a program for executing a method of encoding a sinusoidal signal, the method comprising:

performing sinusoidal tracking for an audio signal, which comprises a first sinusoidal signal whose magnitude is less than a masking value, according to a psychoacoustic model in order to determine a second sinusoidal signal from among sinusoidal signals of a previous frame preceding a current frame which comprises the first sinusoidal signal, and a third sinusoidal signal from among sinusoidal signals of a next frame following the current frame, wherein the second sinusoidal signal and the third sinusoidal signal are connected to the first sinusoidal signal;

encoding the first sinusoidal signal using a particular code indicating that a magnitude of the first sinusoidal signal is less than the masking value according to the psychoacoustic model; and encoding the third sinusoidal signal by performing difference coding for the third sinusoidal signal using only the second sinusoidal signal or both the first sinusoidal signal and the second sinusoidal signal.

16. A method of decoding a sinusoidal signal, the method comprising:

extracting a particular code indicating that a magnitude of a first sinusoidal signal is less than a masking value according to a psychoacoustic model from an input bitstream, wherein the first sinusoidal signal is connected to a third sinusoidal signal to be decoded among sinusoidal signals of a next frame following a current frame which comprises the first sinusoidal signal; and decoding the third sinusoidal signal using only a second sinusoidal signal or both the first sinusoidal signal and the second sinusoidal signal according to a type of the particular code, wherein the second sinusoidal signal is connected to the first sinusoidal signal from among sinusoidal signals of a previous frame preceding the current frame.

17. The decoding method of claim 16, wherein the decoding the third sinusoidal signal according to the type of the particular code comprises, if a flag indicating that the magnitude of the first sinusoidal signal is less than the masking value according to the psychoacoustic model has been designated from among control flags used to encode the first sinusoidal signal or a particular value indicating that the magnitude of the first sinusoidal signal is less than the masking value according to the psychoacoustic model has been encoded instead of a frequency component or a phase component of the first sinusoidal signal, and the flag or the encoded particular value has been included in the input bitstream, obtaining an amplitude component of the third sinusoidal signal by extracting an encoded difference for an amplitude component of the third sinusoidal signal from the input bitstream, decoding the extracted difference for the amplitude component of the third sinusoidal signal, adding the decoded difference for the amplitude component of the third sinusoidal signal to an amplitude component of the second sinusoidal signal;

obtaining a frequency component of the third sinusoidal signal by extracting an encoded difference for a frequency component of the third sinusoidal signal from the input bitstream, decoding the extracted difference for the frequency component of the third sinusoidal signal, adding the decoded difference for the frequency component of the third sinusoidal signal to a frequency component of the second sinusoidal signal; and obtaining a phase component of the third sinusoidal signal by extracting an encoded difference for a phase component of the third sinusoidal signal from the input bitstream, decoding the extracted difference for the phase component of the third sinusoidal signal, adding the decoded difference for the amplitude component of the third sinusoidal signal to a phase component of the second sinusoidal signal.

18. The decoding method of claim 16, wherein the decoding the third sinusoidal signal according to the type of the particular code comprises, if a particular value indicating that the magnitude of the first sinusoidal signal is less than the masking value according to the psychoacoustic model has been encoded instead of an amplitude component of the first sinusoidal signal and has been included in the input bitstream, obtaining an amplitude component of the third sinusoidal signal by extracting an encoded difference for the amplitude component of the third sinusoidal signal from the input bitstream, decoding the extracted difference for the amplitude component of the third sinusoidal signal, adding the decoded difference for the amplitude component of the third sinusoidal signal to an amplitude component of the second sinusoidal signal;

obtaining a frequency component of the third sinusoidal signal by extracting an encoded difference for the frequency component of the third sinusoidal signal from the input bitstream, decoding the extracted difference for the frequency component of the third sinusoidal signal, adding the decoded difference for the frequency component of the third sinusoidal signal to a frequency component of the first sinusoidal signal; and obtaining a phase component of the third sinusoidal signal by extracting an encoded difference for the phase component of the third sinusoidal signal from the input bitstream, decoding the extracted difference for the phase component of the third sinusoidal signal, adding the decoded difference for the phase component of the third sinusoidal signal to a phase component of the first sinusoidal signal.

19. The decoding method of claim 18, further comprising, prior to the decoding the third sinusoidal signal according to the type of the particular code, obtaining the frequency component of the first sinusoidal signal by extracting an encoded difference for the frequency component of the first sinusoidal signal from the input bitstream, decoding the extracted difference for the frequency component of the first sinusoidal signal, adding the decoded difference for the frequency component of the first sinusoidal signal to the frequency component of the second sinusoidal signal; and obtaining the phase component of the first sinusoidal signal by extracting an encoded difference for the phase component of the first sinusoidal signal from the input bitstream, decoding the extracted difference for the phase component of the first sinusoidal signal, adding the decoded difference for the phase component of the first sinusoidal signal to the phase component of the second sinusoidal signal.

20. The decoding method of claim 16, further comprising:

designating a value that is less than the masking value according to the psychoacoustic model as an amplitude component of the first sinusoidal signal; and designating an average frequency value (fp+fn)/2 of a frequency component fp of the second sinusoidal signal and a frequency component fn of the third sinusoidal signal as a frequency component of the first sinusoidal signal.

21. An apparatus for decoding a sinusoidal signal, the apparatus comprising:

a code extraction unit which extracts a particular code indicating that a magnitude of a first sinusoidal signal is less than a masking value according to a psychoacoustic model from an input bitstream, wherein the first sinusoidal signal is connected to a third sinusoidal signal to be decoded, among sinusoidal signals of a next frame following a current frame which comprises the first sinusoidal signal; and a sinusoidal signal decoding unit which decodes the third sinusoidal signal using only a second sinusoidal signal or both the first sinusoidal signal and the second sinusoidal signal according to a type of the particular code, wherein the second sinusoidal signal is connected to the first sinusoidal signal from among sinusoidal signals of a previous frame preceding the current frame.

22. A computer-readable recording medium having recorded thereon a program for executing a method of decoding a sinusoidal signal, the method comprising:

extracting a particular code indicating that a magnitude of a first sinusoidal signal is less than a masking value according to a psychoacoustic model from an input bitstream, wherein the first sinusoidal signal is connected to a third sinusoidal signal to be decoded from among sinusoidal signals of a next frame following a current frame including the first sinusoidal signal; and decoding the third sinusoidal signal using only a second sinusoidal signal or both the first sinusoidal signal and the second sinusoidal signal according to a type of the particular code, wherein the second sinusoidal signal is connected to the first sinusoidal signal among sinusoidal signals of a previous frame preceding the current frame.

* * * * *